US005911372A

United States Patent [19]

Williams, Jr.

[11] Patent Number: 5,911,372

[45] **Date of Patent: *Jun. 15, 1999**

[54] MATERIAL REDUCTION APPARATUS

[76] Inventor: Robert M. Williams, Jr., 9721 Litzinger Rd., St. Louis, Mo. 63124

[ * ] Notice: This patent is subject to a terminal disclaimer.

[21] Appl. No.: 09/006,224

[22] Filed: Jan. 12, 1998

Related U.S. Application Data

[63] Continuation-in-part of application No. 08/790,075, Jan. 28, 1997, Pat. No. 5,743,472.

[51] Int. Cl.[6] ..... B02C 13/31

[52] U.S. Cl. ..... 241/32; 241/36; 241/73; 241/239; 241/285.3

[58] Field of Search ..... 241/73, 32, 36, 241/242, 189.1, 239, 285.3

[56] References Cited

U.S. PATENT DOCUMENTS

| | | | |
|---|---|---|---|
| 730,503 | 6/1903 | Williams . | |
| 2,381,775 | 8/1945 | Roddy . | |
| 2,853,247 | 9/1958 | Anderson . | |
| 3,419,223 | 12/1968 | Morin . | |
| 3,547,358 | 12/1970 | Anderson et al. . | |
| 3,823,878 | 7/1974 | Ishikura . | |
| 3,893,632 | 7/1975 | Helms . | |
| 3,923,256 | 12/1975 | Dorner . | |
| 4,025,990 | 5/1977 | Lovette, Jr. . | |
| 4,394,983 | 7/1983 | Ulsky . | |
| 4,422,581 | 12/1983 | Chryst . | |
| 4,557,421 | 12/1985 | Probst et al. . | |
| 4,706,899 | 11/1987 | Parker et al. . | |
| 4,726,530 | 2/1988 | Miller et al. . | |
| 4,896,836 | 1/1990 | Mitchell . | |
| 5,052,630 | 10/1991 | Hinsey et al. . | |
| 5,213,273 | 5/1993 | Linnerz . | |
| 5,273,218 | 12/1993 | Burns . | |
| 5,299,744 | 4/1994 | Garmater . | |
| 5,452,860 | 9/1995 | Williams . | |
| 5,474,239 | 12/1995 | Williams et al. | 241/73 |
| 5,743,472 | 4/1998 | Williams et al. | 241/32 |

FOREIGN PATENT DOCUMENTS

| | | |
|---|---|---|
| 558654 | 6/1958 | Canada . |
| 11184 | 6/1977 | Japan . |
| 84451 | 4/1993 | Japan . |

OTHER PUBLICATIONS

Cimp/Williams Nife–Hog Bulletin 987 (4 pages).

*Primary Examiner*—Mark Rosenbaum
*Attorney, Agent, or Firm*—Polster, Lieder, Woodruff & Lucchesi, L.C.

[57] ABSTRACT

Material reduction apparatus for reducing waste material consisting of both metallic and non-metallic waste which is required to be rendered separable so that each type of waste material is rendered useable, and apparatus that embodies cutters on a single rotary shaft and a series of stationary cutting blades located in a position to allow the shaft mounted cutters to carry the waste material from the stationary cutting blade to effect the desired reduction of that waste material is provided with structure permitting removal of jammed material.

11 Claims, 6 Drawing Sheets

MATERIAL REDUCTION APPARATUS

CROSS-REFERENCE TO RELATED APPLICATIONS

This application is a continuation-in-part of a prior application Ser. No. 08/790,075 filed Jan. 28, 1997 and entitled MATERIAL REDUCTION APPARATUS now U.S. Pat. No. 5,743,472.

BACKGROUND OF THE INVENTION

This invention is directed to apparatus for grinding and granulating various types of waste material which may contain hard to grind stray material and to a construction in such apparatus adapted to protect the grinding components of the apparatus when hard to grind stray material is encountered in the waste material.

Various shredding apparatus are known in the art. For example, U.S. Pat. No. 5,474,239 issued Dec. 12, 1995 described a particular apparatus for separating materials in tires, for example. The '239 patent is incorporated herein by reference. While the structure disclosed in the '239 patent works well for its intended purpose, I have found that jamming can occur in the apparatus, which often causes expensive repair and considerable down time. The invention described hereinafter provides a device for preventing damage to the equipment, in a relatively straight forward design which permits prompt return of the shredder to operational status.

BRIEF SUMMARY OF THE INVENTION

The problem associated with recovery of the constituents in waste material is overcome by apparatus which accommodates the difficulty of reducing stray components which may be conditioned for further processing to render an overall recovery of the waste material.

The present apparatus is capable of thereby converting waste into useful sub-products in a single processing apparatus that can handle desirable quantities of the assorted waste at a collection station, for example, where such waste material is found.

Therefore, an important object of the invention is to provide apparatus having the ability to convert waste into sub products from a supply which has been cut-up or roughly shredded into pieces, some portions of which are a special object of recovery.

It is also an object of the invention to provide an apparatus for processing waste which can be moved by a system of cutting teeth on a common rotor in a predetermined sequence to effect the reduction of the waste material such that metallic tramp components can be isolated from non-metal waste.

A further object of the invention is to provide a material shredding apparatus with a series of rotating blocks positioned on a common rotor, wherein each block carries multiple-cutting teeth spaced around its circumference to shred the material and progressively distribute the material between the blocks so that waste components can be separated.

Another object of the invention is to provide a material shredding apparatus in which the multiple cutting teeth are easily positionable on the shaft and easily replaceable should damage occur.

Another object of the invention is to provide a structure for preventing damage to the machine should inadvertent jamming of the apparatus during shredding operation, for example occur.

Other objects of the invention will be apparent to those skilled in the art in light of the foregoing description and accompanying drawings.

In accordance with this invention, generally stated, a material reduction apparatus for processing waste includes a frame structure having a waste material inlet side and an outlet side. A rotor is mounted along the frame structure to receive the waste material. A series of circumferentially spaced blocks are mounted on the rotor which operate, in conjunction with an operationally stationary blade associated with said frame structure to reduce material entering the inlet. The blocks are positionable on the rotor such that the teeth rotating with the rotor pass the stationary blade one at a time. A screen is positioned down stream of the tooth blocks to receive the reduced waste material from the frame structure. A control is operatively connected between the blade and the screen for separating the blade and the screen upon the occurrence of a predetermined condition.

BRIEF DESCRIPTION OF THE SEVERAL VIEWS OF THE DRAWINGS

In the drawings.

Corresponding reference numerals are used throughout the several views of the drawings to indicate like components.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what is presently believed to be the best mode of carrying out the invention.

Figure 1:
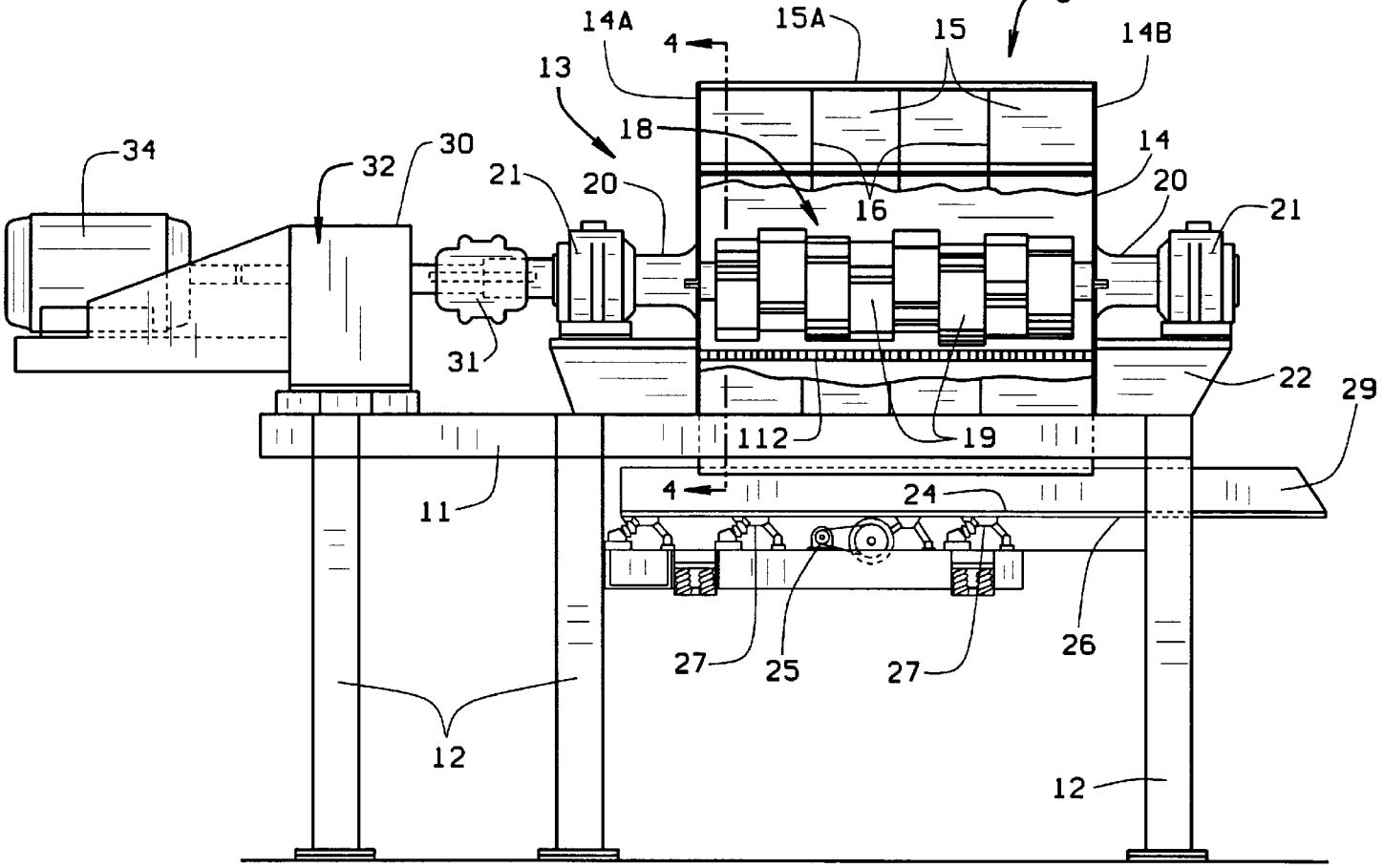
FIG. 1 is a longitudinal side elevation of one illustrative embodiment of apparatus for practicing the invention, the view having a portion broken away to show the environment of the apparatus.

An apparatus assembly 13 seen in FIG. 1 includes a frame 14 having a material receiving inlet 5 formed by panels 15 open at the top 15A and stiffened by ribs 16. The interior space enclosed by the panels 15 is partly broken away to show a single material grinding rotor 18 having a plurality of cutter blocks 19 thereon. The rotor has its opposite ends 20 carried in suitable bearings 21. The rotor 20 is positioned over a base 22 which supports a screen 112. The screen 112 allows the ground waste material, not shown, to be dropped onto a suitable conveyor 26 having a surface 24 caused to vibrate by a motor 25. As the surface 24 is vibrated the material falling on it will be caused to travel to the outlet end 29 of the conveyor 26. Any metallic components in the waste grounded up by the assembly 13 may be seen, and can be pulled out by various devices known in the art, while the non-magnetic waste material drops off the end 29 into a container (not shown). The drive for the rotor 20 is seen in FIG. 1 to include a coupling device 31 which connects the shaft 20 to a speed reduction assembly 32 located in a housing 30 in the usual manner. The assembly 32 is operated by an electric motor 34.

Figure 2:
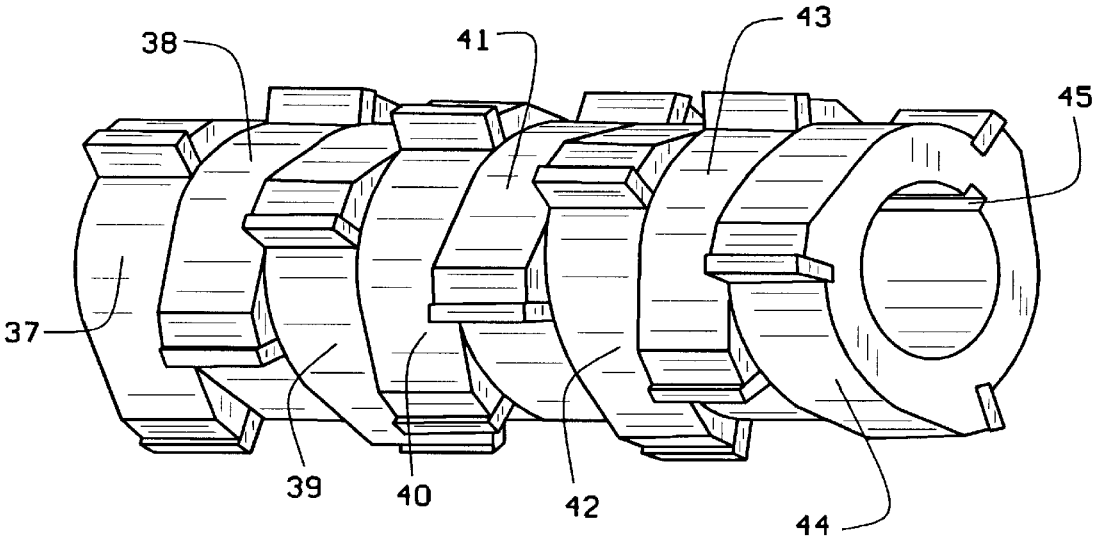
FIG. 2 is a perspective of a series of blocks, each with three cutting teeth arranged in a positioned to be carried by a single rotor (not shown)
Figure 3:
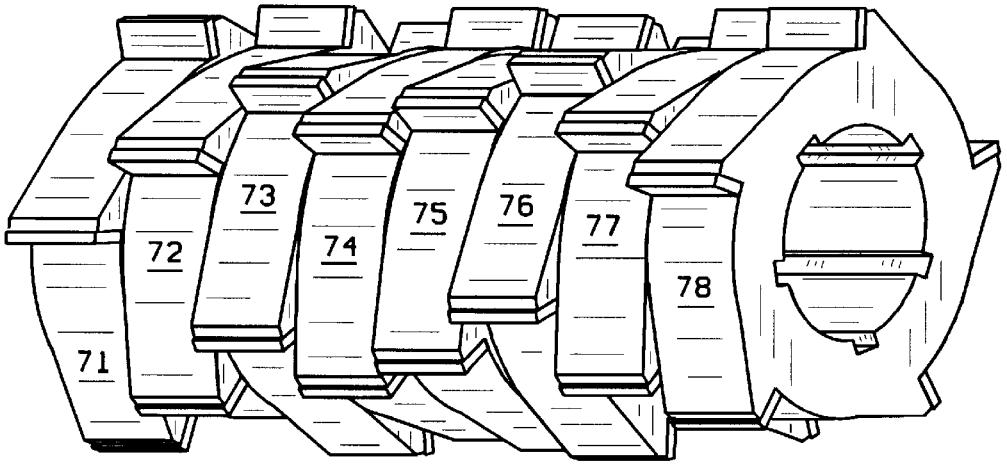
FIG. 3 is a perspective of a modified series of blocks, each series of blocks having five cutting teeth, the blocks being arranged to be mounted on a single rotor (not shown)
Figure 4:
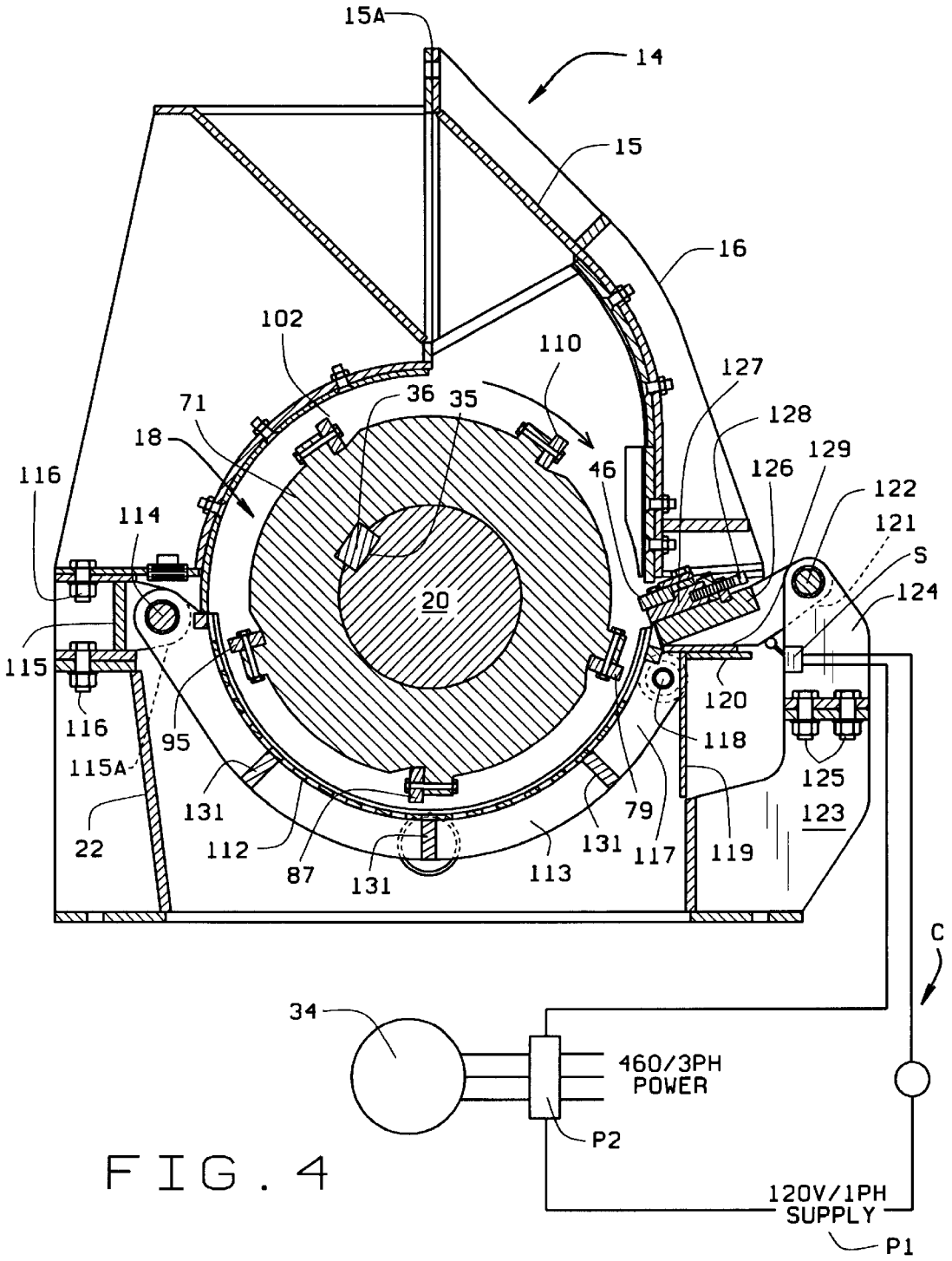
FIG. 4 is a sectional view taken along the line 4—4 of FIG. 1 showing one illustrative embodiment of a protective mechanism for interrupting the operation of the apparatus upon encountering hard to shred material.

The single rotor 20 seen in FIG. 1 and illustrated in section in FIG. 4 has a straight single keyway 35 sized to receive a key 36. The key 36 is common to all of the rotary blocks seen in FIG. 2, as well as FIG. 3. In FIG. 2 those blocks are numbered in order of 37–44. The single keyway 45 in the block 44 (FIG. 2) is limited to that block because each of the other blocks has its own keyway (not shown), due to the selective rotary alignment the cutting teeth must have on the rotor 20. In the alternative, each of the blocks 37–44 may have a plurality of keyways formed in them, as best seen in FIG. 3. In this embodiment, each of the blocks 37–44 may be manufactured identically to one another, and later positioned with respect to key 36 to accomplish the objects of the invention.

In an assembly of eight three-tooth cutter blocks, and with the teeth on each block circumferentially spaced 120° to arrive at the desired arrangement that a single cutting tooth on any given block of the group of blocks 37–44 of FIG. 2 will rotate around to engage a stationary blade 46 seen in the view of FIG. 4. Each of the blocks 37–44 have a plurality of cutters associated with each respective block. By stepping the cutting blocks 37–44 around the rotor 20 selectively as to each keyway it becomes unique to have a cutter 47 on block 37 in FIG. 7 align to engage with the blade 46. The next cutter 48 on block 44 is in position to engage the blade 46. The next cutter 49 on block 38 is in position to engage the blade 46. Thus, it is then followed by cutter 50 on block 43, followed by a cutter 51 in block 39, then by a cutter 52 on block 42, then by a cutter 53 on block 40, and finally a cutter 54 on block 41.

The order of the cutters on the respective blocks, 37–44 follows the same pattern in which each single tooth occurs in an order that moves the waste material to distribute it across the rotor 20 within frame 14. As will be appreciated by those skilled in the art, the number of cutters may vary in embodiment of this invention. One illustrative variation is show in FIG. 6. The operation of the cutter 6 is discussed in greater detail in the above referenced '239 patent. While a cutter spacing of 120° in FIG. 7 and by 72° in FIG. 6 has been set forth in the preceding description, it is to be understood that the tooth spacing for nine teeth in each block involves spacing of 40°. When the number of the cutter blocks on the rotor 20 changes, the circumferential spacing of the teeth on each block changes. The uniqueness of this arrangement is that the frequence of the single cuts on the base cutter bar 46 changes, whereby coarse shredding can be produced by increasing the spacing of the circumferential teeth on each rotor block, and a finer shredding can result by increasing the frequency of the sequence of single cuts on the blade 46. Thus, by selecting cutter blocks having predetermined numbers of circumferentially spaced cutters, the grinding of the trash entering the frame 14 can be selected for a coarse grind or for a fine grind.

Figure 6:
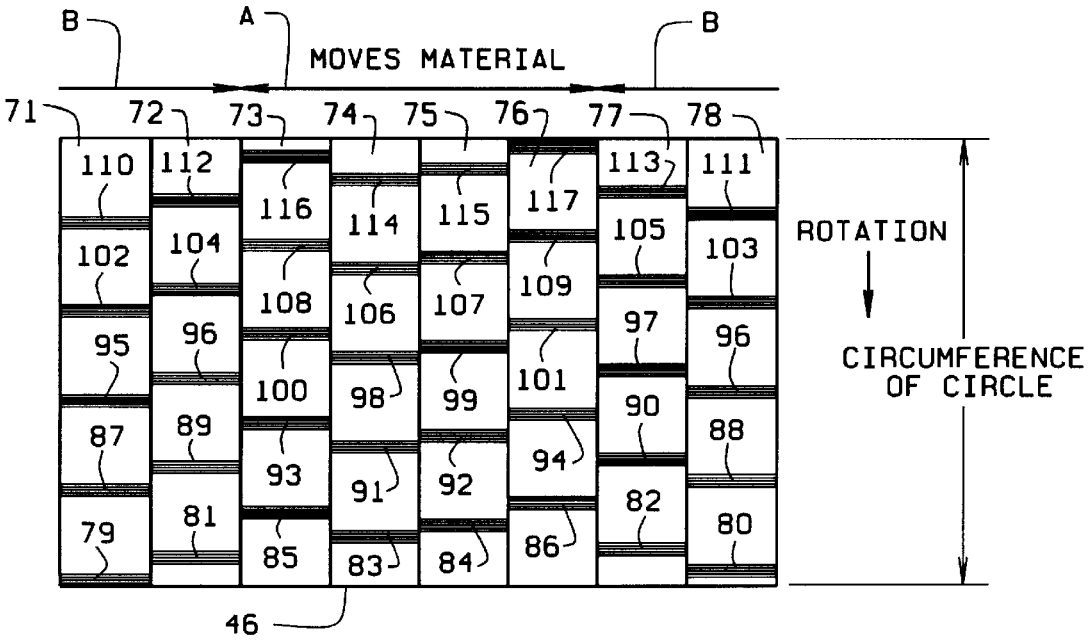
FIG. 6 is a top view of the assembly of blocks of the character seen in FIG. 3 open into a flat form showing the cutter blocks, each with five teeth.
Figure 7:
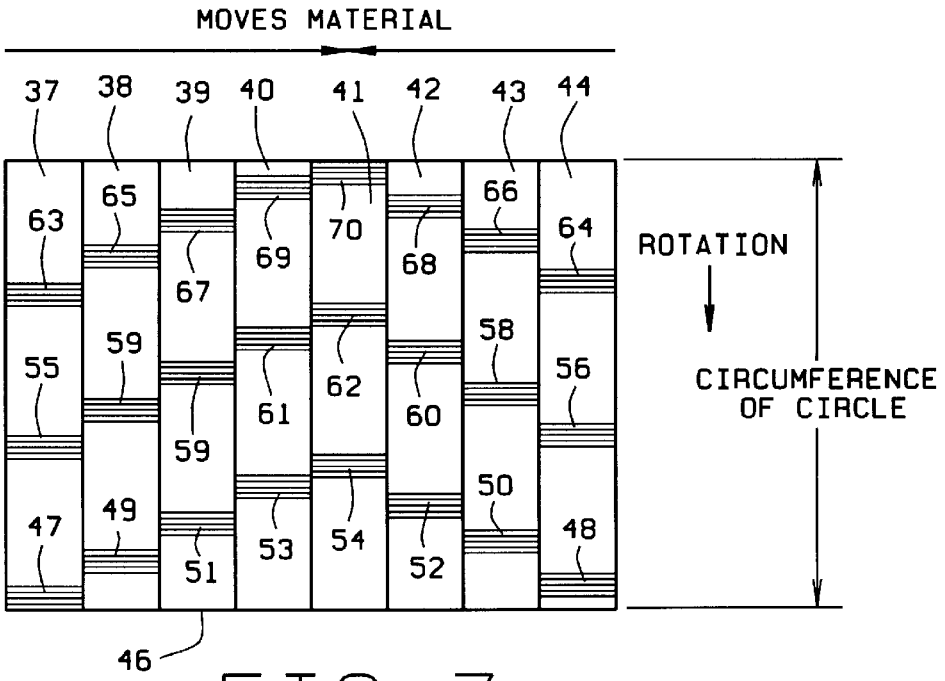
FIG. 7 is a top view of the assembly of blocks of the character seen in FIG. 2 open into a flat form showing the cutter blocks, each with three cutter teeth.

To assure the desired alignment between the cutting edges on the teeth of the rotating blocks of FIGS. 6 and 7 and the stationary cutting blade 46 there is seen in FIG. 4 the provision of adjusting bolts 116 in a support 115 for the screen 112. By adjusting the bolts 116, the screen 112 can be squared up to be aligned properly with the rotor 20. Referring now to FIG. 4, a support plate is positioned to support the blade 46. In the same manner, the support plate 126 and blade 46 can be squared up by the adjusting bolts 125 on the support 124 so the expand cutting edge on the blade 46 can be positioned so it will be aligned to be parallel to the cutting teeth in the blocks on the rotor 20. Thus, the cutting edge on the blade 46 can be secured to be parallel with the teeth in the blocks on rotor 20. Furthermore, employing a waste material grinder in which a cutting impact is generated one tooth at a time, the full energy of the rotor 20 can be applied to the waste material. When tramp material exerting resistance to clean cutting is encountered the energy of the rotor 20 can be applied to the best advantage to such items as tramp metal or the like.

Turning now to FIG. 4, it can be seen that the single shaft 20 carries the rotary five-toothed blocks seen in FIG. 6. The first rotary block 71 is keyed to the shaft 20, and has been rotated so its first cutter 79 has passed the stationary blade 46 and the respective cutter 87 and 95 are rotated over the screen 112. The screen 112 is supported by a rib 113 which is pivotally attached to a rod 114 in the frame 14. The rod 114 is carried in the adjustable support 115, the adjustments being provided by the adjusting bolts 116 as described above. An opposite end 117 of the support rib 113 is retained by a shear pin 118. A movable wall portion 119 in the frame 14 is secured to the end 117 of the rib 113 so an angular extension 120 of that wall portion 119 can assume a raised position to offer support for a pivoted arm 121 carried on a hinge rod 122 positioned in a plurality of stationary brackets 124 in the frame so that adjustment of the pivot extension bracket 124 can be reached to engage the adjustment bolts 125.

When the rotor 20 is employed to drive the cutter blocks having five teeth per block, the sequence is illustrated in FIGS. 3 and 6 where the movement of the waste material follows a pattern determined by the circumferential spacing of 72° in each block. With this spacing in mind the distribution of the waste material is directed toward the opposite ends of the shaft 20 as indicated by the arrow A, and the reverse or inward return movement of the waste materials is inward from the ends of the rotor 20 as indicated by arrows B. In FIG. 6 the stationary blade 46 in FIG. 4 is represented by the straight line 46. As the waste material enters the inlet 5, the rotation of the single shaft 20 will tend to distribute that waste material outwardly in the direction of the arrow A while the action of the cutting teeth on the rotary blocks 71,72 or 78,77 will move the waste material in an inward direction as indicated by the arrows B. In the same manner the waste material is maintained in constant circulation. As the waste material enters the housing of frame 14 it is distributed toward the opposite ends of the frame 14 where the teeth of the end rotor blocks 41,48 and 48,50 reverse the distribution. A different distribution of the waste material occurs in the arrangement of cutting teeth in the blocks 37–44, seen in FIG. 7. Other movement distributions are compatible with the broader aspects of this invention.

In comparing the five tooth rotor blocks of FIG. 6 where the teeth in each block 71–78 are spaced at 72° with the perspective view of FIG. 3 it can be understood that the stationary cutter blade 46 seen in FIG. 4 is represented by the straight line 46 in FIG. 6. Upon rotation of the five tooth blocks relative to the line for blade 46 the sequence of cutting teeth on the blocks 71–78 is such that the tooth 79 on block 71 is followed by a single tooth 80 of block 78, and that tooth 80 is followed by a tooth 81 in block 72, then by a single tooth 82 of block 77. Continuing in the pattern of teeth cooperating with the stationary cutter blade 46, the first tooth 83 of block 74 is followed by tooth 84 of block 75, then tooth 85 of block 73 and finally by tooth 86 in block 76. That sequence of cutter blade in the blocks 71–78 is indicated in FIG. 6 at teeth 87–94; followed by teeth 95–101; then teeth 102–109; and finally by teeth 110–114.

In FIG. 4 there is shown in a schematic manner a control for the drive motor 34 when it is necessary to stop rotation of the rotor 20 upon shearing of the pin 118. When the pin 118 shears the screen support rib 113 pivots out of the way, the pivot arm 121 for the blade 46 pivots down and out of the way so a surface 129 swings down and actuates a switch S in an electrical circuit C which cuts the circuit C to the motor 34 through the 120 V single phase power supply P-1 to the motor 460 V thru 3 phase power P-2. This circuit is well known to those skilled in the art and requires no further explanation other arrangements may be used, if desired.

The stationary blade 46 is adjustably mounted on the support 126 having a position in a seat in the arm 121 which is movable with that arm 121. That bar 126 is adapted to carry the adjustable base 127 for the blade 46 and its adjustment threaded element 128 which permits in-out positioning of the blade 46. It is noted that the pivot arm 121 has a lifting abutment plate 129 located so it can be raised by the angular extension 120 of the wall portion 119 when the screen support ribs 113 are raised so that shear pin 118 can be inserted to fix the ribs in the raised position.

Figure 5:
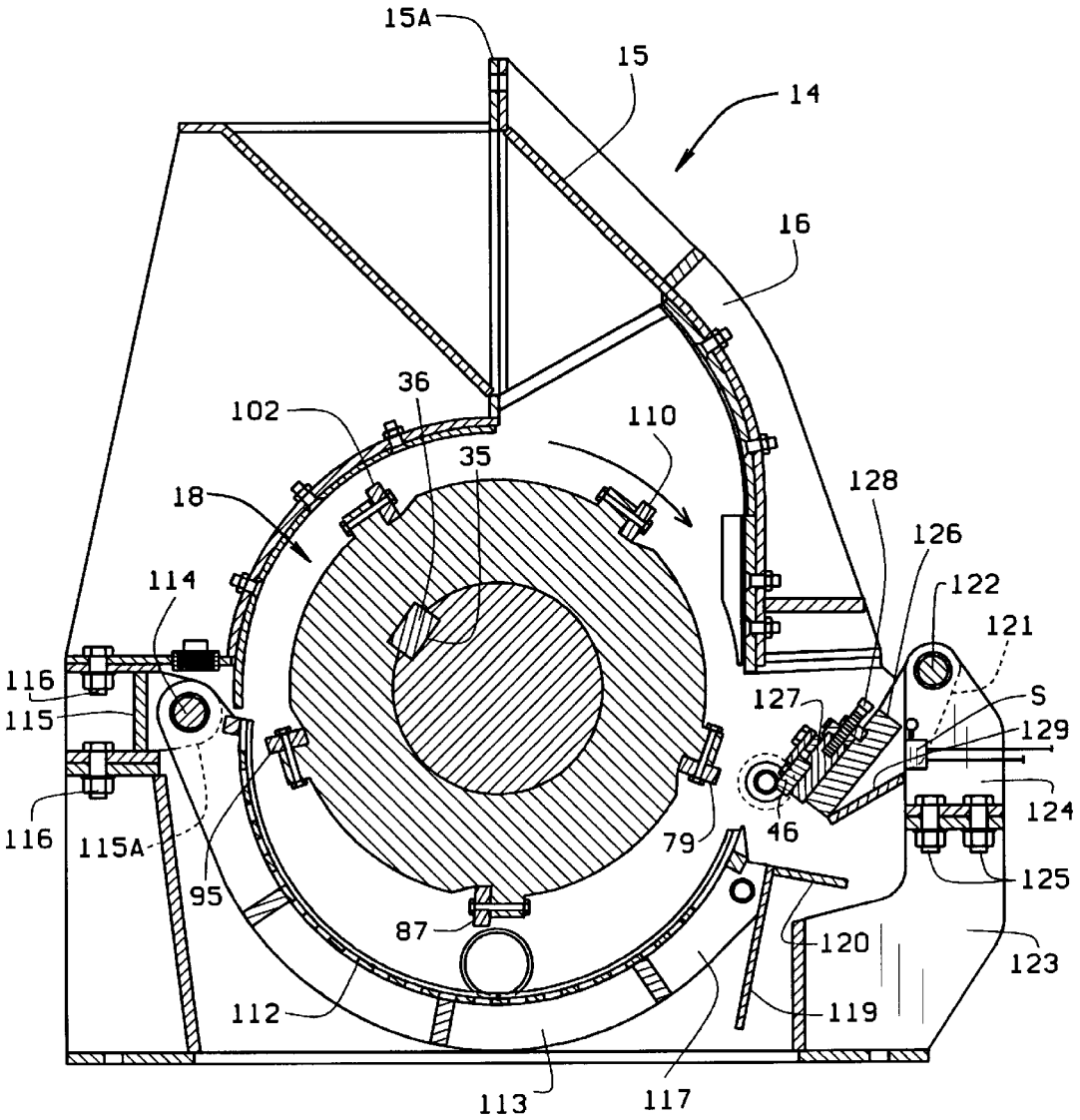
FIG. 5 is a sectional view similar to FIG. 4 showing the operation of the protective mechanism after interrupting the shredding operation.
Figure 8:
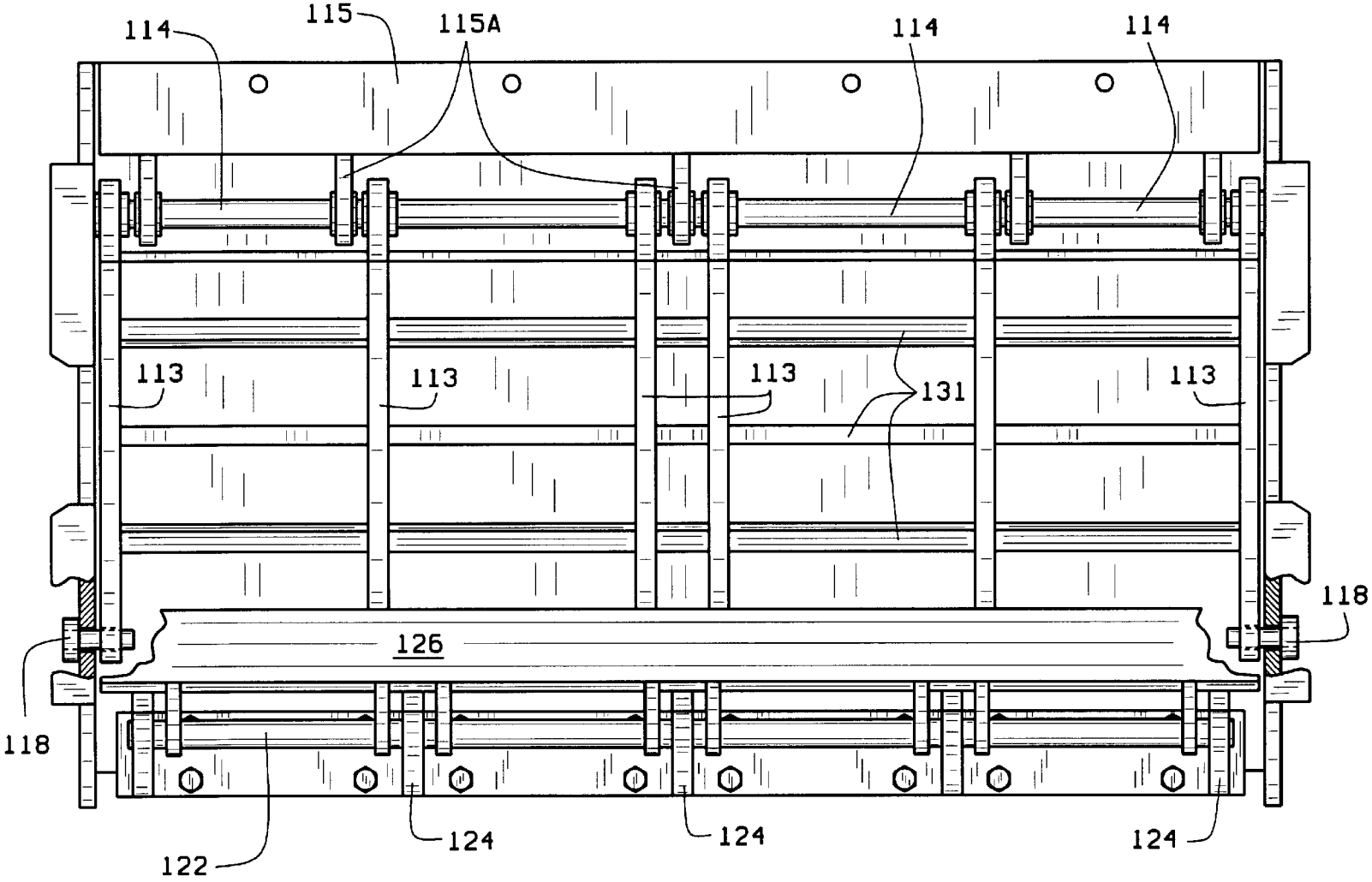
FIG. 8 is a schematic arrangement of the apparatus to accommodate the location of the mechanism seen in FIGS. 4 and 5 to interrupt the reduction of hard to grind materials so such material may be removed.

The view of FIGS. 4 and 5 depict the mechanism for releasing the screen assembly when a hard to grind material is encountered by the stationary blade 46. When that event occurs, the shear pin 118 (See FIG. 8) shears or breaks which allows the screen 112 to drop away on the pivot rod 114, and that event allows the stationary blade 46 to rotate on the rod 122, tripping the motor circuit and shutting down the operation. This also allows the hard material to be found and removed. Thereafter, the screen 112 can be repositioned and held by a replacement shear element. Attention is directed to FIG. 8 to show the assembly for supporting the screen 112. In that plan view there are a plurality of support rib 113 each pivotally attached to hinge support rod 114 carried by fixed supports 115A positioned adjacent the back wall of the frame 14. Those ribs 113 are incorporated in a system of elongated beams assemblies 131 which extends the length of the structure. The ends of the screen support ribs 113 are held by shear pins 118 at the opposite ends of the support bar 126. The support 126 extends lengthwise of the screen 112. When hard material is encountered so the load on either shear pin 118 causes shearing, the entire screen assembly is caused to drop and at the same time the blade 46 drops open as is shown in FIG. 5.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense.

The material reduction apparatus described in the foregoing specification represents a preferred embodiment which may be subject to changes as to form but which follows an equivalent of the principals herein, and that which shall be claimed,

I claim:

1. Material reduction apparatus for processing waste material comprising:

a) a frame structure having a waste material inlet and an outlet;

b) a rotor in said frame structure to receive the waste material;

c) a series of circumferentially spaced toothed blocks on said rotor and a stationary blade means in said frame structure, said block teeth rotating with said rotor and passing said stationary blade means one at a time for reducing the waste material;

d) screen means adjacent said toothed blocks to receive the reduced waste material and discharge such reduced waste material from said frame structure through said outlet; and e) control means operatively connected to said blade means and said screen means for separating said blade means and said screen means upon said blade means encountering hard to reduce portions of waste material.

2. The material reduction apparatus set forth in claim 1 wherein key means on said rotor and keyway means in said series of tooth blocks are angularly offset such that said plurality of teeth elements on said individual blocks are circumferentially offset to assure said block teeth passing said stationary blade one tooth at a time.

3. The material reduction apparatus set forth in claim 1 wherein said control means includes a shear element responsive to a block tooth encountering a hard to reduce waste element for shearing to permit separation of said screen means and said blade means from each other.

4. The material reduction apparatus set forth in claim 1 wherein said series of toothed blades move in said frame structure in a predetermined sequence relative to passing said stationary blade means for reducing and distributing the waste material throughout said frame structure.

5. The material reduction apparatus set forth in claim 1 wherein said toothed blocks on said rotor are distributed along said shaft such that the block teeth move the waste material in a predetermined direction in said frame structure relative to said screen means.

6. Material reduction apparatus comprising:

a) housing assembly with waste material inlet and reduced material outlet;

b) a powered mounted rotor having material feed elements spaced around the periphery of said rotor;

c) material reduction cutter carried by said housing adjacent said shaft mounted rotor;

d) reduction material screen located between said rotor and said reduced material outlet; and e) separate pivot means for said reduction cutter and for said reduction material screen means, said separate pivot means being operative for allowing said cutter and said material screen to separate from said shaft mounted rotor in said housing assembly.

7. The material shredder apparatus set forth in claim 6 wherein said pivotally mounted material cutter includes a lever arm having a pivot connection with said housing assembly to render said cutter movable between a material reducing position relative to said rotor and a position spaced from said rotor to permit material to pass said cutter to said outlet.

8. Material reduction apparatus having an electric motor driving a material reduction rotor on a shaft and in which said apparatus comprises:

a) a housing assembly with waste material inlet and reduced material outlet and a motor driven rotor operable between said housing inlet and outlet;

b) a material reduction means carried on said motor driven shaft to propel material from said inlet to said outlet;

c) a material cutter pivotally mounted in said housing assembly in operative position adjacent to the path of material moved by said material driving elements;

d) screen means pivotally mounted in said housing assembly in operative position to receive material from said rotor, said screen means being in abutment with said pivotally mounted cutter to hold said material cutter in operative position.

e) a shear pin engaged in said screen means for releasably retaining said screen means and material cutter in operative positions;

f) electrical circuit means to supply electric power to the motor for driving said shaft; and g) switch means in said electrical circuit means for interrupting current supply to the motor for driving said shaft in response to shearing of said shear pin to release said screen means and said cutter and stop current supply to the motor driving said shaft.

9. The material shredder apparatus set forth in claim 8 wherein said screen means is supported from a pivot shaft spaced from said shredding cutter and said screen means being free on shearing of said shear pin to pivot out of abutment with said shredding cutter.

10. A material reduction apparatus for processing waste material comprising:

a frame structure having an inlet for receiving waste material;

a rotor mounted for rotation along said frame structure;

a series of cutter blocks mounted to said rotor;

a screen mounted for rotation along said frame and adapted to receive waste material from said rotor;

a support plate mounted for rotation along said frame, said support plate carrying a blade;

a shear device interconnecting said screen and said support plate for releasing the connection between them upon occurrence of a predetermined event;

said screen and the support plate being held in position by said shear device;

a switch mounted to said frame and adapted to be actuated by one of said screen and said support plate; and a motor control operatively connected through said switch and being actuated to remove power to said apparatus upon release of the shear device.

11. A material reduction apparatus for processing waste material comprising:

a frame structure having an inlet for receiving waste material;

a rotor mounted for rotation along said frame structure;

a series of cutter blocks mounted on said rotor;

a screen mounted for rotation pivotally mounted on said frame and adapted to secure waste material from said rotor;

a support plate mounted for rotation to said frame; said support plate carrying a blade;

a shear device interconnecting said screen and said support plate for releasing the connection between them upon occurrence of a preselected event;

a switch mounted to said frame and adapted to be actuated by one of said screen and said support plate; and a motor control operatively connected through said switch and being actuated to remove power to said apparatus upon release of the shear device.

* * * * *